US008795443B2

(12) United States Patent
Nishihara et al.

(10) Patent No.: US 8,795,443 B2
(45) Date of Patent: Aug. 5, 2014

(54) LACQUERED BAKED STEEL SHEET FOR CAN

(75) Inventors: Yuka Nishihara, Tokyo (JP); Katsumi Kojima, Tokyo (JP); Hiroki Iwasa, Tokyo (JP); Yoshun Yamashita, Tokyo (JP)

(73) Assignee: JFE Steel Corporation (JP)

( * ) Notice: Subject to any disclaimer, the term of this patent is extended or adjusted under 35 U.S.C. 154(b) by 608 days.

(21) Appl. No.: 12/596,993

(22) PCT Filed: Apr. 14, 2008

(86) PCT No.: PCT/JP2008/057642

§ 371 (c)(1),
(2), (4) Date: Oct. 22, 2009

(87) PCT Pub. No.: WO2008/136290

PCT Pub. Date: Nov. 13, 2008

(65) Prior Publication Data

US 2010/0116832 A1 May 13, 2010

(30) Foreign Application Priority Data

Apr. 26, 2007 (JP) ..... 2007-117091

(51) Int. Cl.

| | |
|---|---|
| ***C22C 38/14*** | (2006.01) |
| ***C22C 38/12*** | (2006.01) |
| ***C22C 38/04*** | (2006.01) |

(52) U.S. Cl.

USPC ..... 148/330; 148/320; 420/121; 420/126; 420/127

(58) Field of Classification Search

USPC ..... 148/320, 330, 603; 420/121, 126, 127
See application file for complete search history.

(56) References Cited

U.S. PATENT DOCUMENTS

| | | | | |
|---|---|---|---|---|
| 6,221,180 | B1 | 4/2001 | Tosaka et al. | |
| 2012/0067469 | A1 * | 3/2012 | Murakami et al. ..... | 148/645 |

FOREIGN PATENT DOCUMENTS

| | | | |
|---|---|---|---|
| EP | 0 556 834 | | 8/1993 |
| EP | 0 999 288 | A1 | 5/2000 |
| EP | 2 103 703 | | 9/2009 |
| JP | 8-325670 | A | 12/1996 |
| JP | 10-330882 | | 12/1998 |
| JP | 11-199991 | A | 7/1999 |
| JP | 2001-089828 | A | 4/2001 |
| JP | 2001-089829 | A | 4/2001 |
| JP | 2001-107186 | A | 4/2001 |
| JP | 2004-183074 | A | 7/2004 |
| JP | 2008-138234 | A | 6/2008 |
| WO | 99/53113 | A1 | 10/1999 |

OTHER PUBLICATIONS

Machine-English translation of Japanese patent No. 08-325670,Tosaka Akio et al., Dec. 10, 1996.*

* cited by examiner

*Primary Examiner* — Deborah Yee
(74) *Attorney, Agent, or Firm* — DLA Piper LLP (US)

(57) ABSTRACT

A steel sheet undergone precipitation strengthening and refinement in crystal grain size by containing at least one element of 0.005% to 0.05% of Nb, 0.005% to 0.05% of Ti, and 0.0005% to 0.005% of B as a chemical composition is produced through continuous annealing. A steel containing at least one element of Nb, Ti, and B is hot rolled, cooled at a cooling rate of 40° C./s or less, and coiled at 550° C. or higher to facilitate precipitation of cementite after recrystallization annealing. As a result, a steel sheet for a can having a tensile strength of 450 to 550 MPa, a total elongation of 20% or more, and a yield elongation of 5% or less is produced.

14 Claims, No Drawings

LACQUERED BAKED STEEL SHEET FOR CAN

RELATED APPLICATIONS

This is a §371 of International Application No. PCT/JP2008/057642, with an international filing date of Apr. 14, 2008 (WO 2008/136290 A1, published Nov. 13, 2008), which is based on Japanese Patent Application No. 2007-117091, filed Apr. 26, 2007, the subject matter of which is incorporated by reference.

TECHNICAL FIELD

This disclosure relates to a steel sheet for a can and a method for manufacturing the same, wherein the steel sheet is used as a raw material for three-piece cans associated with can barrel forming which is a high level of forming, two-piece cans, such as positive pressured cans, which require buckling resistance, and the like. In particular, it relates to a steel sheet for a can having a small yield elongation and exhibiting high ductility and high strength and a method for manufacturing the same.

BACKGROUND

In recent years, countermeasures, such as a reduction in a can production cost and an introduction of a new model of can, e.g., bottle cans and special shaped cans, on the market, have been instituted to arouse demand for steel cans.

Examples of measures for the reduction in can production cost include a reduction in material cost. Therefore, thickness reductions in steel sheets to be used have been pursued regarding not only two-piece cans associated with drawing, but also three-piece cans primarily associated with simple roll forming.

However, a simple thickness reduction in steel sheet causes a reduction in can body strength. Consequently, steel sheets having simply reduced thicknesses cannot be used for portions formed from high-strength materials, e.g., can body of Drawing-Redrawing Cans (DRD cans) and welded cans, and a very thin, high-strength steel sheet for a can has been required. At present, a very thin, hard steel sheet for a can is produced by a Double Reduce method (hereafter abbreviated as a DR method) in which secondary cold rolling is conducted after annealing. The steel sheet produced by using the DR method has a feature that the strength is high and the yield elongation is small. On the other hand, an application to cans, e.g., special shaped cans which have been introduced on the market recently, associated with can barrel forming, which is a high level of forming, is difficult because the DR material having low ductility exhibits poor formability. In addition, the cost becomes high because the steps for manufacturing the DR material increase as compared with common steel sheets produced by temper rolling after annealing.

To avoid the above-described drawbacks of the DR material, the following patents propose methods for manufacturing a high-strength steel sheet by a Single Reduce method (SR method) in which a secondary cold rolling is omitted and characteristics are controlled through a primary cold rolling step and an annealing step by using various enhancing methods.

Japanese Unexamined Patent Application Publication No. 2001-107186 proposes that a steel sheet for high-strength can on a DR level is produced by adding large amounts of C and N, followed by bake hardening. It is described that the yield stress after the lacquer baking treatment is a high 550 MPa or more, and the resulting hardness can be controlled by the amount of addition of N and a heat treatment.

Likewise, in Japanese Unexamined Patent Application Publication No. 11-199991, the strength is increased by about +50 MPa through the baking treatment after painting as in Japanese Unexamined Patent Application Publication No. 2001-107186.

Japanese Unexamined Patent Application Publication No. 8-325670 proposes a steel sheet keeping strength-ductility in balance by combining strengthening through precipitation of Nb carbides and strengthening through refining in grain size due to carbonitrides of Nb, Ti, and B.

Japanese Unexamined Patent Application Publication No. 2004-183074 proposes a method for increasing the strength by using strengthening through solid solution due to Mn, P, N, and the like.

Japanese Unexamined Patent Application Publication No. 2001-89828 proposes steel sheet for a can having a tensile strength of 540 MPa or less by using strengthening through precipitation of carbonitrides of Nb, Ti, and B and improved moldability of welled portion by controlling the particle diameters of oxide inclusions.

It is indispensable that the strength is ensured to achieve a thinner gauge. On the other hand, in the case where a steel sheet is used for a can body which undergoes a high level of can barrel forming, such as expand forming, or a can body which undergoes a high level of flange forming, it is necessary that a high-ductility steel is applied. Furthermore, a steel exhibiting small change in can height is required for expand forming.

In bottom forming of a two-piece can and can barrel forming typified by expand forming of a three-piece can, a strain at the same level as a few percent of tensile forming is provided. Consequently, it is necessary to apply a steel sheet having a small yield elongation to prevent generation of stretcher-strain. Furthermore, in consideration of the application to highly corrosive contents, a steel sheet exhibiting excellent corrosion resistance is required. Therefore, excessive addition of elements which impair the corrosion resistance is avoided.

In consideration of the above-described characteristics, a steel sheet which satisfies any one of the strength, the ductility, the yield elongation, and the corrosion resistance can be produced by the above-described known technologies. However, a steel sheet which satisfies all the properties cannot be produced.

For example, the methods described in Japanese Unexamined Patent Application Publication Nos. 2001-107186 and 11-199991 in which the strength is increased by adding large amounts of C and N, followed by bake hardening are methods effective for increasing the strength. However, since the amount of solute C and solute N is large, it is estimated that the yield elongation is large.

Japanese Unexamined Patent Application Publication No. 8-325670 describes that the strength is increased by strengthening through precipitation and proposes a steel keeping strength-ductility in balance at a high level. However, the yield elongation is not described. The yield elongation is not obtained by common manufacturing methods.

Japanese Unexamined Patent Application Publication No. 2004-183074 proposes the increase in strength by strengthening through solid solution. However, since P and Mn which are generally known as elements impairing the corrosion resistance are excessively added, there is a high probability that the corrosion resistance is impaired.

In Japanese Unexamined Patent Application Publication No. 2001-89828, a desired strength is obtained by using strengthening through precipitation of Nb, Ti, and the like and refining in grain size. However, from the viewpoint of the formability of a welded portion and the surface properties, addition of oxides of Ti, Ca, and REM is indispensable and, furthermore, it is necessary to control the particle diameters of the oxides. Therefore, an increase in cost and operation problems are expected.

It could therefore be helpful to provide a steel sheet for a can having such characteristics that after lacquer baking, the tensile strength becomes 450 to 550 MPa, the total elongation becomes 20% or more, and the yield elongation becomes 5% or less and exhibiting good corrosion resistance against highly corrosive contents and a method for manufacturing the same.

SUMMARY

A combination of strengthening through precipitation and strengthening through refining in crystal grain size is noted. Strengthening through precipitation and strengthening through refining in crystal grain size due to Nb, Ti, and B are facilitated and, thereby, the strength is allowed to increase without impairing the elongation. Furthermore, Nb, Ti, and B are added, the cooling rate after the hot rolling is reduced and, if necessary, a heat treatment is applied after coiling to increase the cementite ratio in the hot rolled material. In the cooling process after recrystallization annealing, solute C in the steel precipitates while cementite fractured during cold rolling serves as cores. Therefore, to minimize the amount of solute C in the steel after annealing, it is necessary to increase the cementite ratio in the hot rolled material. As a result, regarding a final product, a ferrite structure containing 0.5% or more of cementite results, and an effect of reducing the yield elongation is exerted. The chemical composition of the original sheet is conducted by using the amount of addition of elements within the ranges of not harming the corrosion resistance and, thereby, good corrosion resistance is exhibited against highly corrosive contents.

We thus provide:

[1] A steel sheet for a can, comprising, on a percent by mass basis, 0.03% to 0.13% of C, 0.03% or less of Si, 0.3% to 0.6% of Mn, 0.02% or less of P, 0.1% or less of Al, 0.012% or less of N, at least one element selected from the group consisting of 0.005% to 0.05% of Nb, 0.005% to 0.05% of Ti, and 0.0005% to 0.005% of B, and the balance being iron and incidental impurities;
- a ferrite structure having a cementite ratio of 0.5% or more;
- the ferrite structure having an average ferrite crystal grain size of 7 μm or less;
- a tensile strength after a lacquer baking treatment being 450 to 550 MPa;
- a total elongation of 20% or more; and
- a yield elongation of 5% or less.

[2] The steel sheet for a can according to [1], wherein the ferrite structure has a cementite ratio of 0.5% to 10%.

[3] The steel sheet for a can according to [1], wherein the average ferrite crystal grain size is 4 to 7 μm.

[4] The steel sheet for a can according to [1], wherein the total elongation is 20% to 30%.

[5] The steel sheet for a can according to [1], wherein the yield elongation is 1.5% to 5%.

[6] The steel sheet for a can according to [1], wherein the at least one element is 0.005% to 0.05% of Nb.

[7] The steel sheet for a can according to [1], wherein the at least one element is 0.005% to 0.05% of Ti.

[8] The steel sheet for a can according to [1], wherein the at least one element is 0.0005% to 0.005% of B.

[9] The steel sheet for a can according to [1], wherein the at least one element is 0.005% to 0.05% of Nb and 0.005% to 0.05% of Ti.

[10] The steel sheet for a can according to [1], wherein the at least one element is 0.005% to 0.05% of Nb and 0.0005% to 0.005% of B.

[11] A method for manufacturing a steel sheet for a can, the method comprising the steps of:
- hot rolling a steel comprising, on a percent by mass basis, 0.03% to 0.13% of C, 0.03% or less of Si, 0.3% to 0.6% of Mn, 0.02% or less of P, 0.1% or less of Al, 0.012% or less of N, at least one selected from the group consisting of 0.005% to 0.05% of Nb, 0.005% to 0.05% of Ti, and 0.0005% to 0.005% of B, and the balance being iron and incidental impurities, at a: finishing temperature of the $Ar_3$ transformation point or more;
- cooling the hot rolled steel sheet at an average cooling rate of 40° C./s or less before coiling;
- coiling the cooled hot rolled steel sheet at 550° C. or more;
- pickling the coiled steel sheet;
- cold rolling the pickled steel sheet at a rolling reduction rate of 80% or more;
- annealing the cold rolled steel sheet continuously at a soaking temperature of 670° C. to 760° C. for a soaking time of 40 s or less; and
- temper rolling the continuously annealed steel sheet.

[12] The method for manufacturing a steel sheet for a can according to [11], further comprising the step of heat-treating at a temperature of 200° C. to 500° C. after the coiling step.

[13] The method for manufacturing a steel sheet for a can according to [11], further comprising the step of conducting an over-aging treatment at a temperature of 200° C. to 500° C. after the continuous annealing step.

[14] The method for manufacturing a steel sheet for a can according to [11], wherein the cooling step comprises cooling the hot rolled steel sheet at an average cooling rate of 20° C./s to 40° C./s before coiling.

[15] The method for manufacturing a steel sheet for a can according to [11], wherein the coiling step comprises coiling the cooled hot rolled steel sheet at a coiling temperature of 550° C. to 750° C.

[16] The method for manufacturing a steel sheet for a can according to [11], wherein the continuous annealing step comprises continuous annealing the cold rolled steel sheet at a soaking temperature of 670° C. to 760° C. for a soaking time of 10 to 40 s.

DETAILED DESCRIPTION

Chemical composition of steel in the unit % are on a percent by mass basis. A lacquer baking treatment refers to a treatment corresponding to lacquer baking and laminating and, specifically, a heat treatment is conducted within the range of 170° C. to 265° C. and 12 seconds to 30 minutes. In an example, the heat treatment is conducted at 210° C. for 20 minutes, which is a standard condition.

A high-strength, high-ductility steel sheet for a can having a tensile strength of 450 to 550 MPa, a total elongation of 20% or more, and a yield elongation of 5% or less is obtained. Strength is increased by conducting strengthening through solid solution and strengthening through reduction in grain size in combination due to Nb and Ti without impairing other characteristics. Therefore, a steel sheet having a tensile strength of 450 to 550 MPa can be reliably produced as a final product.

Since the strength of the original sheet increases, it becomes possible to ensure high can body strength even when a welded can is of thinner gauge. Regarding a positive pressured can use requiring buckling resistance of a bottom portion, high buckling resistance can be obtained even when the current gauge is kept. Furthermore, it becomes possible to conduct a high level of can barrel forming, such as expand forming used for welded cans, by increasing the ductility.

Moreover, in bottom forming of a two-piece can and can barrel forming, e.g., expand forming, of a three-piece can, generation of stretcher-strain can be prevented by specifying the yield elongation to be 5% or less.

The steel sheet for a can is a high-strength, high-ductility steel sheet for a can having a tensile strength (hereafter may be referred to as TS) of 450 to 550 MPa, a total elongation of 20% or more, and a yield elongation of 5% or less and exhibiting good corrosion resistance and low aging property. If a steel containing carbon in our selected amount is produced under a common condition, the resulting yield elongation is about 10%. On the other hand, elements, e.g., Nb, Ti, and B, for strengthening through precipitation are added, the cooling rate after the finish rolling in the hot rolling is reduced, and if necessary, a heat treatment is applied after coiling, so as to increase the cementite ratio in the hot rolled material. Solute C in the steel after the cold rolling and the annealing is allowed to precipitate while the cementite serves as cores and, thereby, the amount of solute C in the steel is reduced. Consequently, it is made possible that the yield elongation becomes within the above-described range. Furthermore, regarding the elongation, high elongation can be obtained by applying the above-described method to the above-described chemical composition system. These are features of our steel sheets and methods and are most important factors. In this manner, a high-strength steel sheet for a can having a yield elongation of 5% or less and high elongation of 20% or more is obtained by optimizing the chemical composition centering the elements for strengthening through precipitation and the elements for strengthening through reduction in gain size, the microstructure, and the production condition.

The composition of the steel sheet for a can will be described below.

C: 0.03% to 0.13%

Regarding the steel sheet for a can, it is indispensable that the strength higher than or equal to a predetermined value (tensile strength 450 to 550 MPa) is achieved after continuous annealing and, in addition, a total elongation of 20% or more is exhibited. For this purpose, it is necessary that an average ferrite crystal grain size is specified to be 7 μm or less. To control the yield elongation at 5% or less, which is an important feature, it is necessary that the amount of solute C is reduced during the cooling, process after the annealing. Therefore, the ratio of cementite which serves as a precipitation site of the solute C becomes important. In the production of the steel sheet satisfying these characteristics, the amount of addition of C becomes important. Moreover, precipitation of carbides at grain boundaries has an effect of reducing grain boundary segregation of P. As for the condition satisfying the above-described characteristics, the lower limit of the C content is specified to be 0.03%. In particular, in the case where the tensile strength is 500 MPa or more and the yield elongation is 4% or less, it is desirable that the C content is 0.07% or more. On the other hand, if the amount of addition of C exceeds 0.13%, cracking occurs in a hypoperitectic steel during the cooling process of melting. Therefore, the upper limit is specified to be 0.13%.

Si: 0.03% or less

An element Si increases the strength of the steel by strengthening through solid solution. However, the addition of Si exceeding 0.03% impairs the corrosion resistance significantly. Therefore, the amount of addition of Si is specified to be 0.03% or less.

Mn: 0.3% to 0.6%

An element Mn increases the strength of the steel by strengthening through solid solution and reduce the crystal grain size. An effect of reduction in the crystal grain size is exerted significantly when the amount of addition of Mn is 0.3% or more, and the amount of addition of Mn of at least 0.3% is required for ensuring the desired strength. Therefore, the lower limit of amount of addition of Mn is specified to be 0.3%. On the other hand, if the content of Mn exceeds 0.6%, the corrosion resistance and the surface characteristics deteriorate. Therefore, the upper limit is specified to be 0.6%.

P: 0.02% or less

An element P has high ability to strengthen through solid solution. However, if the amount of addition exceeds 0.02%, the corrosion resistance deteriorates. Therefore, the amount of addition is specified to be 0.02% or less.

Al: 0.1% or less

As the Al content increases, an increase in recrystallization temperature results, so that it is necessary to increase the annealing temperature. The recrystallization temperature is increased by the other elements added to increase the strength and the annealing temperature increases. Consequently, it is advantageous to minimize the increase in recrystallization temperature due to Al. Therefore, the Al content is specified to be 0.1% or less.

N: 0.012% or less

An element N is necessary to enhance aging hardening. On the other hand, if large amounts of N is added, slab cracking easily occurs in a lower bending zone, in which the temperature decreases, during continuous casting. Therefore, the N content is specified to be 0.012% or less. It is desirable that 0.005% or more of N is added to exert an aging hardening effect.

Nb: 0.005% to 0.05%

Nb is an important element to be added. The element Nb has high ability to produce carbides, fine carbides are allowed to precipitate, and grains are made finer, so that the strength increases. The grain size has an influence on not only the strength, but also the surface properties in the drawing. If the average ferrite crystal grain size of the final product exceeds 7 μm, a surface roughening phenomena occurs partly after the drawing, and beautiful appearance of the surface is lost. The strength and the surface properties can be adjusted by the amount of addition of Nb. Furthermore, Nb is added, the cooling rate after the finish rolling in the hot rolling is reduced, and coiling is conducted at high temperatures, so that precipitation of cementite can be facilitated and the yield elongation can be reduced. This effect is exerted when the Nb content exceeds 0.005%. Therefore, the lower limit is specified to be 0.005%. On the other hand, Nb increases the recrystallization temperature. Consequently, if the content exceeds 0.05%, the annealing becomes difficult, for example, a portion which has not yet been recrystallized remains partly after the continuous annealing at an annealing temperature of 670° C. to 760° C. for a soaking time of 40 s or less. Therefore, the upper limit of the amount of addition of Nb is specified to be 0.05%.

Ti: 0.005% or more and 0.05% or less

Addition of Ti is conducted to obtain the strength and the yield elongation for the same reason as that in the case of Nb. This effect is exerted when the content is 0.005% or more. Therefore, the lower limit is specified to be 0.005%. The upper limit is specified to be 0.05% from the viewpoint of the recrystallization temperature, as in the case of Nb.

B: 0.0005% or more and 0.005% or less.

An element B exerts an effect of reducing the yield elongation because B based precipitates in the ferrite grains serve as cores and, thereby, the precipitation of cementite is facilitated. This effect is exerted when the B content exceeds 0.0005%. Therefore, the lower limit is specified to be 0.0005%. The upper limit is specified to be 0.005% from the viewpoint of the recrystallization temperature.

Regarding S, a particular specification is not included in Claims. However, a desirable condition is the following range.

S: 0.01% or less.

The steel has high Nb, C, and N contents. Therefore, cracking of a slab edge easily occurs in the bending zone during continuous casting. From the viewpoint of prevention of the slab cracking, it is desirable that the amount of addition of S is specified to be 0.01% or less.

The remainder includes Fe and incidental impurities.

The microstructure of the steel sheet for a can will be described below. Ferrite single phase structure containing 0.5% or more of cementite, average ferrite crystal grain size: 7 μm or less:

The microstructure is specified to be a ferrite single phase structure containing 0.5% or more of cementite. To control the yield elongation at 5% or less, it is necessary that solute C in the steel is allowed to precipitate as cementite during cooling after the annealing. Regarding a steel having a cementite ratio of less than 0.5%, solute C remains and the desired yield elongation is not obtained. Therefore, the cementite ratio is specified to be 0.5% or more. In the case where the yield elongation is controlled at 4% or less, it is desirable that the cementite ratio is specified to be 1.0% or more. An aging index serving as an index of the solute C will be described later. On the other hand, if the cementite ratio exceeds 10%, the ductility deteriorates. Therefore, preferably, the upper limit of the cementite ratio is 10%. The cementite ratio was calculated by measuring an area percentage occupied by the cementite relative to a unit area in a field of view observed with an optical microscope.

If the average ferrite crystal grain size exceeds 7 μm, a surface roughening phenomena occurs partly after the drawing, and beautiful appearance of the surface is lost. Therefore, the ferrite crystal grain size is specified to be 7 μm or less. A smaller ferrite crystal grain size is preferable from the viewpoint of enhancement of the tensile strength. A small crystal grain size can be obtained by, for example, increasing the amount of reduction in the hot rolling and the cold rolling. However, if an achievement of the crystal grain size smaller than 4 μm is intended, problems occur in that, for example, the rolling load in the above-described rolling step becomes too large and variations in sheet thickness increase in the rolling step. Consequently, it is preferable that the ferrite crystal grain size is specified to be 4 μm or more. The ferrite crystal grain size is measured on the basis of, for example, the average ferrite crystal grain size by a cutting method in JIS G0551. The average ferrite crystal grain size is controlled at a desired value by the chemical composition, the cold rolling reduction rate, and the annealing temperature. Specifically, C is 0.03% to 0.13%, Si is 0.03% or less, Mn is 0.3% to 0.6%, P is 0.02% or less, Al is 0.1% or less, N is 0.012% or less, at least one type of 0.005% to 0.05% of Nb, 0.005% to 0.05% of Ti, and 0.0005% to 0.005% of B is added, and hot rolling is conducted at a finishing temperature higher than or equal to the $Ar_3$ transformation point. Thereafter, cooling at an average cooling rate of 40° C./s or less, coiling, pickling, and cold rolling at a rolling reduction rate of 80% or more are conducted. Subsequently, continuous annealing at a soaking temperature of 670° C. to 760° C. for a soaking time of 40 s or less and temper rolling are conducted, so that the crystal grain size of 7 μm or less is obtained.

Tensile strength: 450 to 550 MPa

The tensile strength is specified to be 450 MPa or more to ensure the dent strength of the welded can and the buckling resistance of the two-piece can regarding a thick sheet of about 0.2 mm. On the other hand, if an achievement of the strength exceeding 550 MPa is intended, addition of large amounts of elements is required, and there is a risk that the corrosion resistance is impaired. Therefore, the strength is specified to be 550 MPa or less.

The tensile strength is controlled at a desired value by the chemical composition, the cold rolling reduction rate, and the annealing temperature. Specifically, C is 0.03% to 0.13%, Si is 0.03% or less, Mn is 0.3% to 0.6%, P is 0.02% or less, Al is 0.1% or less, N is 0.012% or less, at least one type of 0.005% to 0.05% of Nb, 0.005% to 0.05% of Ti, and 0.0005% to 0.005% of B is added, and hot rolling is conducted at a finishing temperature higher than or equal to the $Ar_3$ transformation point. Thereafter, cooling at an average cooling rate of 40° C./s or less, coiling, pickling, and cold rolling at a rolling reduction rate of 80% or more are conducted. Subsequently, continuous annealing at a soaking temperature of 670° C. to 760° C. for a soaking time of 40 s or less and temper rolling are conducted, so that the tensile strength is controlled at a desired value.

Total elongation: 20% or more:

If the total elongation is less than 20%, application to a can associated with a high level of can barrel forming, such as expand forming, becomes difficult. Therefore, the lower limit of the total elongation is specified to be 20%. From the viewpoint of can barrel forming, it is desirable that the upper limit of the total elongation is as high as possible. However, an increase in total elongation causes reduction in tensile strength at the same time. From the viewpoint of ensuring the tensile strength, it is preferable that the total elongation is specified to be 30% or less. The total elongation is controlled at a desired value by the chemical composition, the cooling rate after finishing in hot rolling, and the coiling temperature.

Yield elongation: 5% or less

The yield elongation is specified to be 5% or less to prevent generation of stretcher-strain in bottom forming of a two-piece can and can barrel forming of a three-piece can. In particular, it is desirable that the yield elongation is specified to be 4% or less for the use in which the demand for the stretcher-strain is severe.

The yield elongation is controlled at a desired value by the chemical composition, the cooling rate after finishing in the hot rolling, the coiling temperature, the heat treatment after the coiling, and the over-aging treatment after the annealing. It is desirable that the lower limit of the yield elongation is as small as possible. To obtain a small yield elongation, it is necessary to reduce the cooling rate after finishing in the hot rolling, raise the coiling temperature, facilitate the carbide precipitation after the coiling, and conduct the over-aging treatment after the annealing for a long time. Under these operating conditions, the productivity is impaired and the production cost increases. To reduce the yield elongation within the bounds of not impairing the productivity, it is preferable that the yield elongation is specified to be 1.5% or more.

The aging index is not specifically limited. However, a desirable condition is the following range.

Aging index: 20 MPa or less

To obtain a desired yield elongation, it is necessary that solute C in the steel is allowed to precipitate as cementite during cooling process after the annealing and, thereby, the amount of solute C is reduced. It is desirable that the aging index is specified to be 20 MPa or less to obtain the yield elongation of 5% or less.

A method for manufacturing a steel sheet for a can will be described below.

A molten steel adjusted to contain the above-described chemical composition is made by a commonly known steel making method including a converter and the like and is casted into a slab by a commonly employed casting method, e.g., a continuous casting method.

A hot rolled sheet is produced through hot rolling by using the slab obtained as described above. Preferably, the temperature of the slab at the start of rolling is 1,250° C. or higher. The finishing temperature is specified to be higher than or equal to the $Ar_3$ transformation point. Cooling is conducted at a cooling rate of 40° C./s or less before coiling, and coiling is conducted at a temperature of 550° C. or higher. After pickling and cold rolling at a rolling reduction rate of 80% or more are conducted, continuous annealing is conducted at a soaking temperature of 670° C. to 760° C. for a soaking time of 40 s or less, followed by temper rolling.

Hot rolling finishing temperature: higher than or equal to $Ar_3$ transformation point The finish rolling temperature in the hot rolling is an important factor to ensure the strength. If the finishing temperature is lower than the $Ar_3$ transformation point, grains grow through hot rolling in a two phase zone of $\gamma+\alpha$, so that the strength is reduced. Therefore, the hot rolling finishing temperature is specified to be higher than or equal to the $Ar_a$ transformation point.

Average cooling rate after finish rolling and before coiling: 40° C./s or less

The yield elongation which is an important factor is influenced significantly by the cooling rate after the finish rolling. To control the yield elongation and the total elongation after the cold rolling and the annealing at desired values, it is necessary that the cooling rate after the hot rolling is reduced so as to precipitate cementite in the hot rolled material. Regarding the condition therefor, the average cooling rate after the finishing is specified to be 40° C./s or less. On the other hand, when the cooling rate becomes less than 40° C./s, the grain size of the hot rolled steel sheet increases so as to cause reduction in tensile strength of the steel. Therefore, 20° C./s or more is preferable.

Coiling temperature: 550° C. or higher

The coiling temperature is an important factor for controlling the strength, the ductility, and the yield elongation, which are important, at desired values. If the coiling temperature is 550° C. or lower, it is necessary that the cooling rate before the coiling is higher than 40° C./s and occurrences of various operational problems are expected. Therefore, the lower limit is specified to be 550° C. Furthermore, to control the yield elongation at 4% or less, it is necessary that cementite is allowed to precipitate after the hot rolling as much as possible so as to increase the cementite ratio at the start of cooling in the annealing step. Regarding the condition therefor, it is desirable that the coiling temperature is specified to be 620° C. or higher. To control the yield elongation at 3% or less, it is desirable that the coiling temperature is specified to be 700° C. or higher. On the other hand, if the coiling temperature is 750° C. or higher, the amount of generation of iron oxides on the thermally changed steel sheet surface increases, and the load for removing them increases. Therefore, preferably, the coiling temperature is 750° C. or lower.

Heat treatment condition after hot rolling: 200° C. or higher, and 500° C. or lower Regarding the use in which generation of stretcher-strain is minimized, it is necessary to control the yield elongation after the continuous annealing at 2% or less. The yield elongation is reduced by precipitating cementite in the hot rolled material and precipitating solute C during cooling process in the annealing. However, it is difficult to obtain the above-described yield elongation before the coiling step. Therefore, preferably, a heat treatment is conducted after the coiling. If the heat treatment temperature is lower than 200° C., the above-described effect cannot be exerted. Therefore, the lower limit is specified to be 200° C. On the other hand, if the heat treatment temperature exceeds 500° C., since the precipitated cementite forms a solid solution, the upper limit is specified to be 500° C.

Cold rolling reduction rate (reduction rate): 80% or more

The reduction rate in the cold rolling is one of important conditions. If the reduction rate in the cold rolling is less than 80%, it is difficult to produce a steel sheet having a tensile strength of 450 MPa or more. Furthermore, if the cold rolling reduction rate is less than 80%, at least the hot rolled sheet is required to have a thickness of 1 mm or less to obtain a sheet thickness on a DR material level (about 0.17 mm), while this is difficult from the viewpoint of operation. Therefore, the rolling reduction rate is specified to be 80% or more.

Annealing condition: soaking temperature 670° C. to 760° C., soaking time 40 s or less Continuous annealing is employed as the annealing. The soaking temperature is required to be higher than or equal to the recrystallization temperature of the steel sheet to ensure good formability. In addition, the soaking temperature is specified to be 670° C. or higher to further homogenize the microstructure. On the other hand, to conduct continuous annealing at higher than 760° C., minimization of the rate is required for preventing breakage of the steel sheet, so that the productivity is reduced. It is desirable that the recrystallization is completed within the range of 670° C. to 720° C. from the viewpoint of the productivity. Regarding the soaking time, the productivity cannot be ensured at a rate exceeding 40 s. Therefore the soaking time is specified to be 40 s or less. It is desirable that the soaking time is 10 s or more in order to achieve complete recrystallization.

Over-aging treatment: 200° C. to 500° C.

The yield elongation is reduced by conducting an over-aging treatment after soaking annealing. If the temperature is lower than 200° C., diffusion of C becomes slow and precipitation of solute C in the steel becomes difficult. Therefore, the lower limit is specified to be 200° C. On the other hand, if the temperature becomes 500° C. or higher, the operation becomes difficult. Therefore, the upper limit is specified to be 500° C.

The temper rolling reduction rate is not specified in Claims. However, a desirable range is described below.

Temper rolling reduction rate: 2.0% or less

As the temper rolling reduction rate becomes high, the ductility is reduced because the strain provided during forming increases, as in the case of DR material. A very thin material is required to ensure the total elongation of 20% or more. Therefore, it is desirable that the temper rolling reduction rate is 2.0% or less.

EXAMPLE 1

A steel having the composition shown in Table 1 where the remainder included Fe and incidental impurities was made with an actual converter to obtain a steel slab. The resulting steel slab was reheated at 1,250° C., hot rolled at a finish rolling temperature of 880° C. to 900° C., cooled at a cooling rate of 20° C./s to 50° C./s before coiling, and coiled at a coiling temperature of 550° C. to 750° C. After pickling, cold rolling was conducted with a rolling reduction rate of 90% or more, so as to produce a thin steel sheet of 0.2 mm. The resulting thin steel sheet was heated to 690° C. to 760° C. at a heating rate of 15° C./sec, and continuous annealing was conducted at 690° C. to 760° C. for 20 to 30 seconds. After cooling, temper rolling was conducted in such a way that the rolling reduction rate became 1% to 2%, and common chromium plating was conducted continuously, so that a tin-free steel was obtained. Detailed production condition is shown in Table 2.

TABLE 1

(percent by mass)

| Steel | C | Si | Mn | P | S | N | Nb | Ti | B | Al | Remarks |
|---|---|---|---|---|---|---|---|---|---|---|---|
| 1 | 0.07 | 0.01 | 0.6 | 0.01 | 0.005 | 0.01 | 0.035 | — | — | 0.050 | Invention Example |
| 2 | 0.09 | 0.01 | 0.6 | 0.02 | 0.005 | 0.002 | 0.020 | — | — | 0.050 | Invention Example |
| 3 | 0.12 | 0.01 | 0.6 | 0.01 | 0.005 | 0.01 | 0.020 | — | — | 0.050 | Invention Example |
| 4 | 0.12 | 0.01 | 0.6 | 0.02 | 0.005 | 0.01 | 0.020 | 0.02 | — | 0.055 | Invention Example |
| 5 | 0.12 | 0.01 | 0.5 | 0.01 | 0.005 | 0.004 | 0.020 | — | 0.002 | 0.050 | Invention Example |
| 6 | 0.12 | 0.01 | 0.5 | 0.01 | 0.005 | 0.01 | 0.010 | — | 0.004 | 0.050 | Invention Example |
| 7 | 0.03 | 0.01 | 0.6 | 0.01 | 0.01 | 0.004 | 0.050 | — | — | 0.050 | Invention Example |
| 8 | 0.02 | 0.01 | 0.6 | 0.01 | 0.005 | 0.01 | — | — | — | 0.050 | Comparative Example |

TABLE 2

| Level | Steel | Finish rolling temperature (° C.) | Cooling rate after finishing (° C./s) | Coiling temperature (° C.) | Heat treatment temperature (° C.) | Cold rolling reduction rate (%) | Annealing temperature (° C.) | Soaking time (s) | Over-aging temperature (° C.) | Remarks |
|---|---|---|---|---|---|---|---|---|---|---|
| 1 | 1 | 880 | 30 | 700 | — | 91 | 720 | 30 | — | Invention Example |
| 2 | 1 | 900 | 20 | 750 | — | 91 | 690 | 25 | — | Invention Example |
| 3 | 2 | 880 | 35 | 550 | — | 91 | 720 | 20 | — | Invention Example |
| 4 | 2 | 880 | 30 | 640 | — | 91 | 720 | 20 | — | Invention Example |
| 5 | 2 | 900 | 25 | 720 | — | 90 | 710 | 30 | — | Invention Example |
| 6 | 2 | 900 | 25 | 720 | 400 | 91 | 690 | 30 | — | Invention Example |
| 7 | 3 | 880 | 25 | 720 | — | 90 | 710 | 30 | — | Invention Example |
| 8 | 3 | 880 | 25 | 720 | — | 90 | 710 | 30 | 400 | Invention Example |
| 9 | 3 | 880 | 40 | 550 | — | 91 | 710 | 30 | — | Invention Example |
| 10 | 3 | 880 | 50 | 550 | — | 91 | 710 | 30 | — | Comparative Example |
| 11 | 4 | 880 | 30 | 640 | — | 91 | 710 | 30 | — | Invention Example |
| 12 | 5 | 880 | 30 | 680 | — | 91 | 710 | 30 | — | Invention Example |
| 13 | 5 | 880 | 30 | 550 | 350 | 91 | 720 | 30 | — | Invention Example |
| 14 | 5 | 900 | 20 | 750 | 350 | 91 | 720 | 30 | 400 | Invention Example |
| 15 | 6 | 900 | 40 | 550 | — | 90 | 760 | 30 | — | Invention Example |
| 16 | 6 | 880 | 30 | 640 | — | 91 | 710 | 30 | — | Invention Example |
| 17 | 6 | 880 | 25 | 720 | — | 91 | 710 | 30 | — | Invention Example |
| 18 | 7 | 880 | 25 | 720 | 400 | 91 | 720 | 20 | 400 | Invention Example |
| 19 | 8 | 880 | 30 | 640 | — | 91 | 710 | 30 | — | Comparative Example |

The thus obtained plated steel (tin-free steel) was subjected to a lacquer baking treatment at 210° C. for 20 minutes. Thereafter, a tensile test was conducted, and a crystal structure and an average crystal grain size were examined. The examination methods are as described below.

The tensile test was conducted by using a tensile test piece of JIS No. 5 size. The tensile strength (TS) and the elongation (El) were measured and the strength, the ductility, and the aging property were evaluated.

A sample was polished, crystal grain boundaries were etched with nital, and the crystal structure was observed with an optical microscope.

Regarding the crystal structure observed as described above, the average crystal grain size was measured by using the cutting method based on JIS G5503.

The obtained results are shown in Table 3.

TABLE 3

| Level | Steel | TS (MPa) | YP-EI (%) | EI (%) | Average crystal grain size (μm) | Cementite ratio (%) | Remarks |
|---|---|---|---|---|---|---|---|
| 1 | 1 | 490 | 3.5 | 25 | 5.0 | 1.1 | Invention Example |
| 2 | 1 | 470 | 3 | 28 | 7.0 | 1 | Invention Example |
| 3 | 2 | 520 | 4.8 | 22 | 5.0 | 1.2 | Invention Example |
| 4 | 2 | 500 | 3.2 | 26 | 5.5 | 1.4 | Invention Example |
| 5 | 2 | 490 | 2.5 | 27 | 6.0 | 1.4 | Invention Example |
| 6 | 2 | 490 | 1.5 | 27 | 6.0 | 1.5 | Invention Example |
| 7 | 3 | 530 | 3.0 | 21 | 5.0 | 1.8 | Invention Example |
| 8 | 3 | 520 | 2.5 | 23 | 5.0 | 1.9 | Invention Example |
| 9 | 3 | 540 | 5.0 | 21 | 5.0 | 1.7 | Invention Example |
| 10 | 3 | 540 | 6.0 | 21 | 5.0 | 0.4 | Comparative Example |
| 11 | 4 | 520 | 4.0 | 22 | 5.5 | 1.7 | Invention Example |
| 12 | 5 | 520 | 3.5 | 26 | 5.5 | 1.7 | Invention Example |
| 13 | 5 | 520 | 2.5 | 25 | 5.0 | 1.8 | Invention Example |
| 14 | 5 | 500 | 1.5 | 26 | 6.0 | 1.9 | Invention Example |
| 15 | 6 | 520 | 4.0 | 24 | 4.5 | 1.8 | Invention Example |
| 16 | 6 | 510 | 2.5 | 27 | 4.5 | 1.8 | Invention Example |
| 17 | 6 | 500 | 1.9 | 27 | 5.0 | 1.9 | Invention Example |
| 18 | 7 | 460 | 5.0 | 30 | 5.5 | 0.5 | Invention Example |
| 19 | 8 | 430 | 10.0 | 30 | 7.0 | 0.3 | Comparative Example |

As is clear from Table 3, regarding Invention Examples (Level Nos. 1 to 9, 11 to 18), the average crystal grain size is 7 μm or less, and the microstructure is a homogeneous, fine ferrite structure containing 0.5% or more of cementite. Therefore, the yield elongation is small, and both of excellent strength and excellent ductility are exhibited.

On the other hand, regarding Comparative Example (No. 10), the cooling rate after the finish rolling is high. Therefore, the cementite ratio is small and the yield elongation is inferior to those of Invention Examples.

Regarding Comparative Example (No. 19), the amounts of addition of C, Nb, Ti, and B are out of our range. Therefore, the cementite ratio is small and the strength and the yield elongation are inferior to those of Invention Examples.

Industrial Applicability

A steel sheet excellent in all the characteristics of strength, ductility, and yield elongation is obtained. Therefore, the steel sheet is best suited for a steel sheet for cans primarily including three-piece cans associated with can barrel forming at a high level of forming and two-piece cans associated with a few percent of forming of bottom portions.

What is claimed is:

1. A lacquer baked treated steel sheet comprising, on a percent by mass basis, 0.03% to 0.13% of C, 0.03% or less of Si, 03% to 0.6% of Mn, 0.02% or less of P, 0.1% or less of Al, 0.012% or less of N, at least one element selected from the group consisting of (1005% to 0.05% of Nb, 0.005% to 0.05% of Ti, and (10005% to (1005% of B, and the balance being iron and incidental impurities;

a ferrite structure having a cementite ratio of 0.5% or more;

the ferrite structure having an average ferrite crystal grain size of 7μm or less;

a tensile strength of 450 to 550 MPa;

a total elongation of 20% or more; and a yield elongation of 5% or less.

2. The steel sheet according to claim 1, wherein the ferrite structure has a cementite ratio of 0.5% to 10%.

3. The steel sheet according to claim 1, wherein the average ferrite crystal grain size is 4 to 7 μm.

4. The steel sheet according to claim 1, wherein the total elongation is 20% to 30%.

5. The steel sheet according to claim 1, wherein the yield elongation is 1.5% to 5%.

6. The steel sheet according to claim 1, wherein the at least one element is 0.005% to 0.05% of Nb.

7. The steel sheet according to claim 1, wherein the at least one element is 0.005% to 0.05% of Ti.

8. The steel sheet according to claim 1, wherein the at least one element is 0.0005% to 0.005% of B.

9. The steel sheet according to claim 1, wherein the at least one element is 0.005% to 0,05% of Nb and 0.005% to 0.05% of Ti.

10. The steel sheet according to claim 1, wherein the at least one element is 0.005% to 0,05% of Nb and 0.0005% to 0.005% of B.

11. A can comprising the steel sheet according to claim 1.

12. The steel sheet according to claim 1, wherein the ferrite structure has a cementite ratio of 1.0 to 10%.

13. The steel sheet according to claim 1, having a yield elongation of 1.5 to 4%.

14. The steel sheet according to claim 1, having a yield elongation of 1.5 to 4%. wherein the ferrite structure has a cementite ratio of 1.0 to 10%.

* * * * *

UNITED STATES PATENT AND TRADEMARK OFFICE

CERTIFICATE OF CORRECTION

PATENT NO. : 8,795,443 B2
APPLICATION NO. : 12/596993
DATED : August 5, 2014
INVENTOR(S) : Nishihara et al.

It is certified that error appears in the above-identified patent and that said Letters Patent is hereby corrected as shown below:

In the Claims,

In Column 13

At line 49, please change "(1005%" to -- 0.005% --; and

At line 50, please change "(10005% to (1005%" to -- 0.0005% to 0.005% --.

In Column 14

At line 44, please change "0,05%" to -- 0.05% --.

Signed and Sealed this
Twenty-fourth Day of February, 2015

Michelle K. Lee

Michelle K. Lee
*Deputy Director of the United States Patent and Trademark Office*